US005661271A

United States Patent [19]

Moser

[11] Patent Number: 5,661,271

[45] Date of Patent: Aug. 26, 1997

[54] ACOUSTIC SPEAKER ENCLOSURE HAVING A STACKED CONSTRUCTION

[76] Inventor: Charles E. Moser, 2998 Heidi Dr., San Jose, Calif. 95132

[21] Appl. No.: 462,079

[22] Filed: Jun. 5, 1995

[51] Int. Cl.[6] ..... A47B 81/06

[52] U.S. Cl. ..... 181/199

[58] Field of Search ..... 181/148, 151, 181/160, 199, 207; 381/88, 158, 159, 205

[56] References Cited

U.S. PATENT DOCUMENTS

| | | | |
|---|---|---|---|
| 1,997,790 | 4/1935 | Heidrich . | |
| 3,617,654 | 11/1971 | Heidrich | 181/151 X |
| 3,720,285 | 3/1973 | Russell et al. . | |
| 3,779,337 | 12/1973 | Gregory . | |
| 4,130,174 | 12/1978 | Ostrander et al. . | |
| 4,281,738 | 8/1981 | Jackson . | |
| 4,437,541 | 3/1984 | Cross . | |
| 4,569,414 | 2/1986 | Fulton . | |
| 4,591,020 | 5/1986 | Hruby, Jr. . | |
| 4,964,482 | 10/1990 | Meyer | 181/151 X |

OTHER PUBLICATIONS

Advertisement From *Audio* Magazine, Oct., 1994.

*Primary Examiner*—Khanh Dang

*Attorney, Agent, or Firm*—Townsend and Townsend and Crew LLP

[57] ABSTRACT

An audio speaker enclosure comprises a plurality of structural layers or panels having openings which are in communication. Layers of damping material are interspersed between the structural layers, attenuating vibrations and preventing interaction between drivers in separate chambers. Additionally, the openings in the structural layers may vary, allowing the acoustic chamber behind the driver to have curved surfaces, thereby reducing resonance.

18 Claims, 3 Drawing Sheets

ACOUSTIC SPEAKER ENCLOSURE HAVING A STACKED CONSTRUCTION

BACKGROUND OF THE INVENTION

1. Field of the Invention

The present invention relates generally to loudspeaker enclosures, and more particularly to a high-fidelity loudspeaker enclosure having a stacked construction to provide a shaped acoustic chamber and isolation between the individual drivers in a multiple driver speaker.

In the field of high-fidelity music reproduction, substantial efforts have been made to obtain sound reproduction which is as faithful as possible to the original recorded sound. In most systems, tones are reproduced by individual diaphragms which are moved by a combination of permanent magnets and voice coils through which electrical signals are passed. The individual diaphragms with their magnetic and electrical apparatus are referred to as drivers. Unfortunately, each driver is capable of faithfully reproducing sound within only a limited frequency range. For this reason, modern high-fidelity speaker enclosures incorporate a number of individual drivers, which together cover the full audio spectrum.

The sound quality of a speaker system depends on both the drivers and the structure supporting the drivers. Each driver in a speaker system moves two masses of air. The first mass, in front of the diaphragm, vibrates with the intended frequencies to produce the desired tones. The second mass, behind the diaphragm, also vibrates with similar frequencies. However, the soundwaves which propagate from the back of a driver are out of phase with the intended sound reproduction, and unless carefully controlled, can significantly distort the sounds produced. It is for this reason that the rear surfaces of drivers are generally surrounded by speaker enclosures.

Although multiple driver speaker enclosures do successfully reproduce music with acceptable quality, there are at least two factors which have limited the quality of sound reproductions. The first factor is that speaker drivers, when combined with standard speaker enclosures, result in systems which have inherent resonant frequencies. This problem is most acute for lower frequency sounds, producing unnatural "booming," an emphasis on particular bass tones at specific frequencies. Much of this distortion is produced by the flat parallel surfaces of conventional speaker cabinet enclosures. The radiating soundwaves within such enclosures strike these flat surfaces, bouncing back and forth between them, and thereby causing standing waves within the enclosure. These standing waves interfere with the proper operation of the speaker in response to various frequencies. Efforts have been made to tailor the enclosures to the drivers by having baffled ports, known as "bass reflex," or alternatively by sealing the enclosure, known as "acoustic suspension." Nonetheless, non-linear response characteristics caused by intermodulation can be quite noticeable, even in the best of conventional speaker systems.

The second problem which has limited the quality of sound reproduction with conventional speaker enclosures is the interaction between the individual drivers of a multiple driver speaker system. As noted above, multiple drivers are required to reproduce the full spectrum of the audio range. As different drivers are moving at different frequencies, the vibrations set up by an individual driver on a speaker enclosure may well interfere with an alternate driver vibrating in an alternate frequency range which shares the same acoustic chamber. Moreover, vibrations also propagate through the speaker structure, so that drivers having chambers which are isolated by a simple baffle will still suffer the effects of the adjacent driver producing an alternate frequency.

The problems which are presented by conventional speaker enclosures have been recognized in the past, and attempts have been made to overcome them. To avoid establishing standing waves within a parallel wall speaker enclosure, speaker enclosures have been manufactured having a spherical or elliptical acoustic chamber behind the speaker. By using such curved inner surfaces in the speaker interior, the development of standing waves within the enclosure has been minimized. To improve the isolation between drivers in a multiple driver speaker system, separate speaker enclosures have been used specifically for the bass drivers. Unfortunately, music recordings are generally engineered for reproduction by two-speaker stereo systems, and further separation of the sound source is often undesirable. Alternatively, large, heavy speaker enclosures having walls between the individual drivers of sufficient mass to reduce vibration passed between chambers have also been constructed.

These prior art approaches at overcoming the limitations of speaker fidelity have met with only limited commercial success. The difficulty in constructing shaped speaker enclosures, together with the sound source separation and space use problems of a multiplicity of individual speaker enclosures, have limited the commercial acceptance of these prior art approaches.

For the above reasons it would be desirable to provide a speaker construction which would allow tailoring of the individual driver chambers. It would be particularly desirable if such construction techniques would further allow isolation between individual driver chambers within a multiple driver speaker enclosure. It would be best if such techniques did not require expensive or exotic materials or machining, and if the resulting speaker enclosures did not require any additional space.

2. Description of the Background Art

U.S. Pat. No. 4,591,020, issued to Hruby, Jr., describes a speaker enclosure having first and second interconnected chambers. The first chamber may be formed from a plurality of adjacent panels. The panels each have central openings that combine to form a cylindrical interior volume. U.S. Pat. No. 4,281,738, issued to Jackson, describes a spherical speaker enclosure for a single bass driver. U.S. Pat. No. 4,437,541, issued to Cross, describes a controlled dispersion speaker having a plurality of baffles.

U.S. Pat. No. 3,779,337, issued to Gregory, describes a speaker mount assembly having alternate layers of rigid blocks and vibration damping material. U.S. Pat. No. 4,569,414, issued to Fulton, describes a speaker system having a plurality of individual driver enclosures which are separated by a vibration damping material. U.S. Pat. No. 4,130,174, issued to Ostrander et al., describes a speaker formed with blocks of open cell foam and a thin pad of closed cell foam to provide isolation between drivers. U.S. Pat. Nos. 3,720,285 and 1,997,790 are also generally of interest.

SUMMARY OF THE INVENTION

The present invention provides a loudspeaker enclosure which is particularly useful in reproducing sound without the booming resonant tones or the interaction between the individual drivers required to accurately reproduce the full spectrum of the audio range. The present speaker construction provides flexibility to tailor the acoustic shape of the chamber behind each individual driver. Additionally, the separate chambers of the present speaker enclosure are acoustically isolated, so that vibrations within a single chamber do not pass either through the enclosed air, or through the speaker structure, to an adjacent chamber. The present speaker construction thereby overcomes both the flat panel resonance and the driver interaction which have limited sound reproduction quality to date.

A speaker enclosure according to the present invention comprises a plurality of structural layers and a plurality of damping layers interspersed with the structural layers so as to form a stack. A first plurality of the structural layers have openings which are in communication so as to define an acoustically shaped chamber. A second plurality of structural layers have openings which are also in communication, forming a second acoustically shaped chamber. Advantageously, the masses of the structural layers are separated by the damping layers so as to inhibit vibrations between the first and the second chambers. Preferably, at least one of the first and second chamber is substantially spherical in shape. In alternate embodiments, at least one of the first and second chamber are substantially cylindrical in shape. Further acoustic chamber shapes may also be easily formed, including shapes having complex, three-dimensional curves, allowing the present speaker to be tailored to a particular driver so as to complement the driver's output characteristics.

As used herein, "substantially spherical" and "substantially cylindrical" refer to the gross shape of the volume defined by the openings in the plurality of the structural layers. These openings are optionally formed as simple right-angle cuts in flat structural layer panels. This stacked construction method thereby provides the advantages of complex speaker enclosure shapes without the complexity required to precisely form the theoretically desirable three-dimensional curved surfaces.

The structural layers of the present speaker enclosure are generally formed as substantially planar panels. The structural layers preferably comprise wood, particle board, plastic, or fiber-reinforced polymer. The structural layers will preferably be oriented at an angle to a line connecting the driver ports, ideally having a plurality of complete structural layers separating a first and second acoustic chamber. Such a stack will herein be referred to as a "vertical" stack, with individual layers indicated as a "top," "bottom," etc. Such designations are for reference only. Alternatively, the structural layers may be stacked "horizontally," having the structural layers in line with the driver ports. However, such horizontal stacks will increase the transmission of vibrations between acoustic chambers along the common structural layers.

The damping material of the present speaker enclosure will comprise compressible sheets separating at least a plurality of the structural layers. The damping material will preferably comprise rubber, latex, silicon, urethane, neoprene, or the like. The elasticity and damping coefficient of the damping layer will vary with the mass of the structural layers, with the frequency of the vibrations being damped, and with the weight of the portion of the enclosure supported by the damping layer.

The stacked structural and damping layers are preferably held in place by tension rods running between a bottom layer and a top layer. Preferably, the rods are isolated from the structural layers which form the first and second chambers. This isolation is easily provided by over-sizing the rod passages between the top and bottom structural layers. Advantageously, this prevents the transmission of acoustic frequencies between the first and second chamber via the rods.

DETAILED DESCRIPTION OF THE SPECIFIC EMBODIMENTS

The present invention provides a speaker enclosure formed from a plurality of structural layers. The individual structural layers are easily-shaped, substantially rigid panels, several of which have simple openings. By stacking the structural layers with the openings in communication, resonance-reducing acoustic chambers may be formed. Furthermore, by separating the structural layers with vibration-absorbing damping material, separate chambers may be effectively isolated within a single speaker enclosure. The present enclosure will find use in both bass-reflex and acoustic suspension speaker systems.

Figure 1:
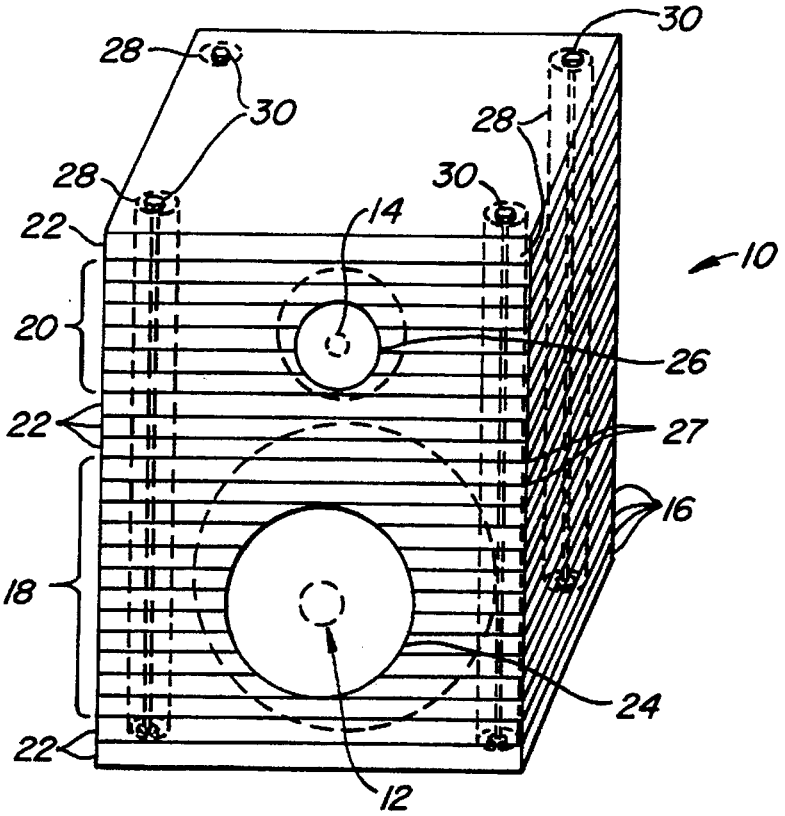
FIG. 1 is a perspective view of a first embodiment of a speaker enclosure according to the present invention.

Referring now to FIG. 1, the present invention comprises a speaker 10 which will accept a bass driver 12 and a high-frequency driver 14. Speaker enclosure 10 is formed as a stack of structural layers 16. A first group of the structural layers 18, form a spherical chamber behind the bass driver 12. A second group of structural layers 20 form a second spherical chamber for high-frequency driver 14. Closed structural layers 22 are located at the top and bottom of speaker enclosure 10. Additional closed structural layers 22 are located between the first and second chambers. Bass and high-frequency driver ports 24 and 26, respectively, are provided for mounting the drivers.

Alternating between the structural layers 16 are vibration-damping layers 27. Vibration-damping layers 27 thus separate the individual structural layers 16. Vibration-damping layers 27 are compressible, having behavior which is a combination of elastomeric and plastic. These materials thereby absorb acoustic frequencies, reducing the transmission of interfering vibrations between acoustic chambers, but resiliently support the weight of the speaker.

The stack of structural and damping layers which form speaker enclosure 10 are held together by tension rods 30. At least the first and second groups of structural layers 18, 20, are provided with oversized tension rod passages 28 to isolate these structural layers from the tension rods. Advantageously, this prevents transmission of acoustic frequencies between the chambers via the tension rods 28. Alternatively, the structural and damping layers may be bonded or bolted, but any bolts between structural layers are preferably damped to avoid transmission of vibrations between structural layers.

Figure 2:
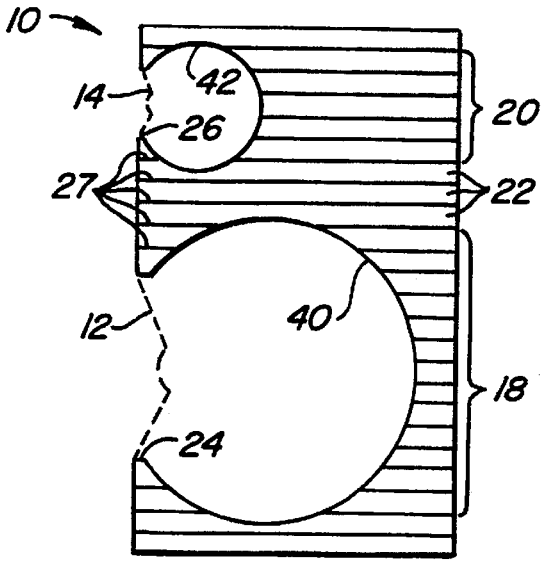
FIG. 2 is a cross-sectional view of the speaker enclosure of FIG. 1.

Referring now to FIG. 2, a cross-section of the speaker enclosure 10 clearly shows a large spherical bass driver chamber 40, and a smaller spherical high-frequency driver chamber 42. As described above, the bass chamber 40 and high-frequency chamber 42 are formed from a first group 18 and a second group 20 of structural layers. These groups do not include any common structural layers, and advantageously, the chambers are further separated by a series of complete structural layers 22 alternated with damping layers 27. These alternating layers will prevent vibrations created by bass driver 12 from interfering with the high-frequency chamber 42 or the high-frequency driver 14. Additionally, the spherical shape of the bass and high-frequency chambers 40, 42 will prevent standing waves and the resulting resonant frequencies, associated with conventional parallel surface speaker enclosures. Alternative acoustic shapes may also be formed, including ellipsoid or cylindrical, or some combination of such shapes.

Figure 3:
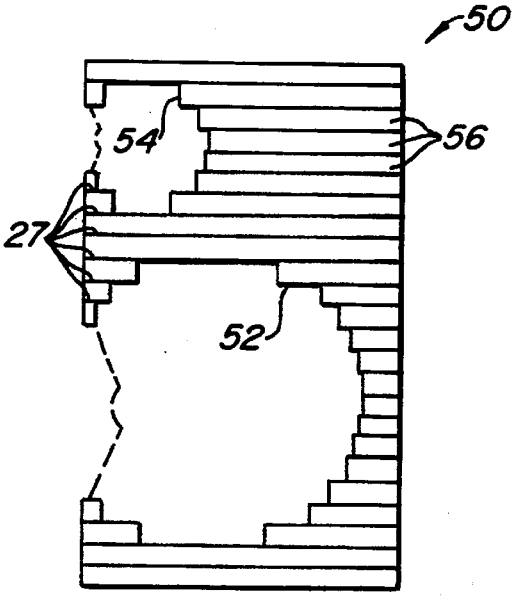
FIG. 3 is a cross-sectional view of an alternative speaker enclosure according to the present invention.

Referring now to FIG. 3, an alternate embodiment of the present speaker enclosure 50 is also formed as a stack of structural layers having damping layers interspersed. Speaker enclosure 50 has a bass chamber 52 and a high-frequency chamber 54 which are "substantially spherical." These substantially spherical chambers function as described above, however, they are formed by right-angle circular cuts in structural layers 56. Such cuts are possible with common tools, eliminating any need for expensive machining or three-dimensional curves. Alternatively, a simple angle cut might be used with angles varying for different structural layers. Such angled cuts could again be made by common tools, and although they would increase the complexity of fabricating the present speaker enclosure, they would also provide a closer approximation to the theoretically ideal spherical chambers of the embodiment of FIG. 2.

The individual layers which form this present speaker enclosure will be described with reference to FIGS. 4–6. Complete structural layer 22 comprises a substantially flat panel, preferably formed from wood, particle board, plastic, or fiber-reinforced polymer. Complete structural layer 22 is substantially rigid, and typically has a thickness in the range from 0.25 inch to two inches. Oversized rod passages 28 have a diameter sufficient to prevent contact between the panel and the tension rods (see FIG. 1). Optionally, lightening holes or shapes may be cut into complete structural panel 22 to reduce the overall weight of the speaker enclosure. However, reducing the mass of the complete structural layers 22 will also decrease the effective isolation between chambers separated by these layers.

A structural layer 60 having an enclosed opening 62 is typical of the structural layers forming the first and second groups 18, 20. Enclosed opening 62 extends between the two major surfaces of this structural layer. The opening is enclosed in that it does not extend to any edge of the structural layer. In contrast, a structural layer 64 has an extended opening 66 which does extend to an edge 68 of the structural layer 64. Driver port section 70 is formed at the interface between the extended opening 66 and the edge 68 of the structural layer. Similar adjacent driver port sections combine to form the driver port to the acoustic chamber. Structural layers 60 and 64 again include tension rod passages 28. Alternatively, additional lightening holes or lightening passages in these panels to reduce the overall weight of the speaker enclosure. As described above, openings 62 and 66 may be formed as right-angle cuts through the structural layers, or alternatively, may be simple angled cuts which more closely approximate the ideal spherical chamber shape. Optionally the cuts are formed as complex three-dimensional curves which provide the ideal spherical enclosure shape.

Figure 4:
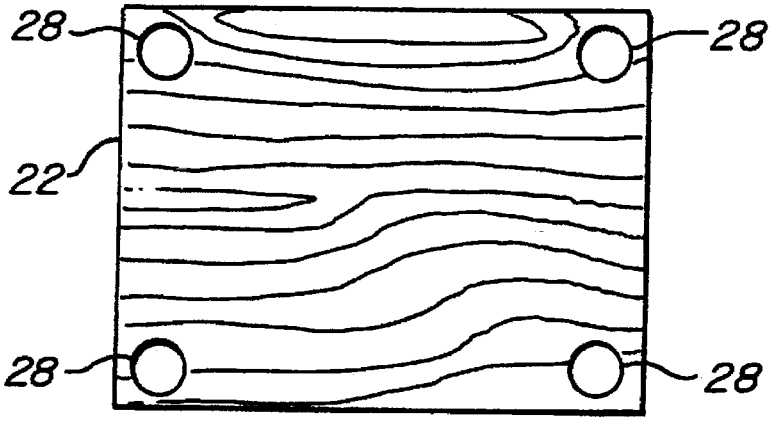
FIGS. 4–6 are views from above of individual structural layers which form the speaker enclosure of the present invention.
Figure 5:
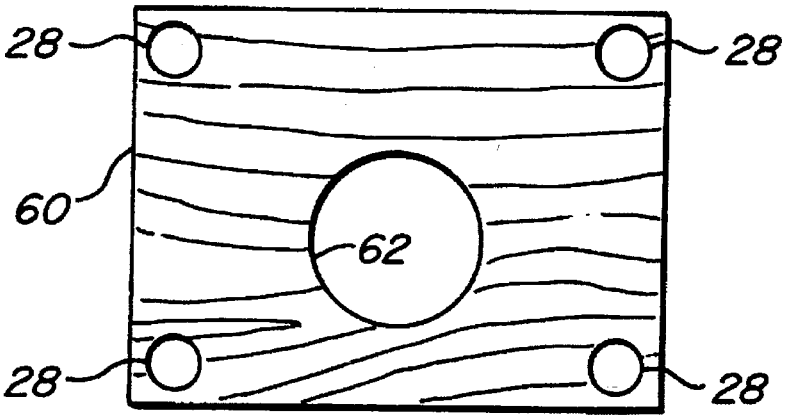
Figure 6:
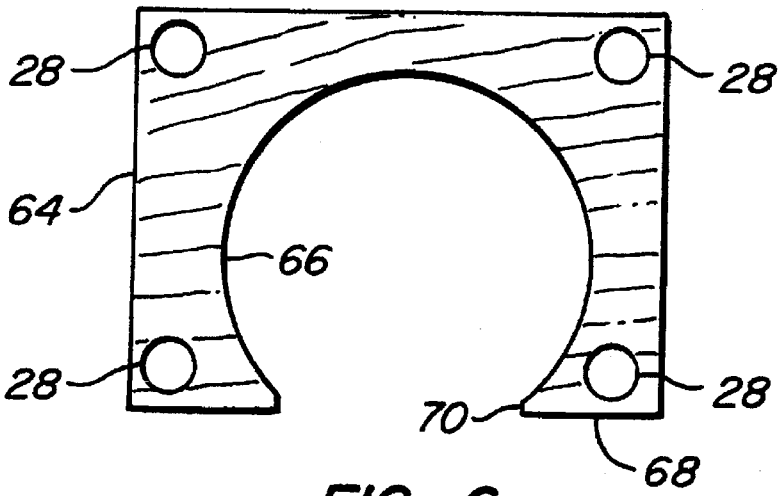

The damping layers between the structural layers of FIGS. 4–6 are formed as substantially planar sheets of damping material cut to the shapes of an associated structural layer. The damping layers comprise a damping material, preferably comprising rubber, latex, silicon, urethane, or neoprene. The damping layers are both somewhat elastomeric and somewhat plastically deformable. They are thereby able to deform so as to absorb vibrations but they then expand gradually to maintain the structural separation between the structural layers. The damping layers optionally include lightening holes or cut away shapes in areas that are not adjacent to the openings in the structural layers which form the acoustic chambers. The damping layers typically have a thickness in the range from 0.1 inch to 0.5 inch.

Figure 7:
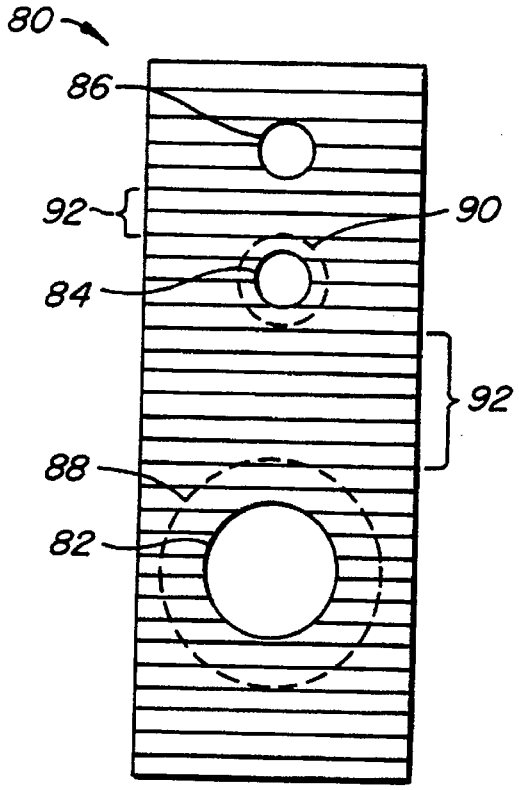
FIG. 7 is preferred embodiment of the speaker enclosure of the present invention.

A preferred embodiment of the speaker enclosure of the present invention is illustrated in FIG. 7. The preferred speaker enclosure 80 includes a bass driver port 82, a mid-range driver port 84, and a high-frequency driver port 86. A spherical bass chamber 88 and spherical mid-range chamber 90 are behind bass port 82 and mid-range port 84, respectively. High-frequency port 86 does not require an acoustically-shaped chamber as certain high-frequency drivers are essentially surface-mounted on the front surface of a speaker enclosure. Between each of the drivers of preferred speaker enclosure 80 are numerous complete structural layers alternated with damping layers 92, as described above. These multiple complete structural layers act as isolation layers between the drivers of the enclosure, preventing any interference between the different frequency ranges of the different drivers.

Figure 8:
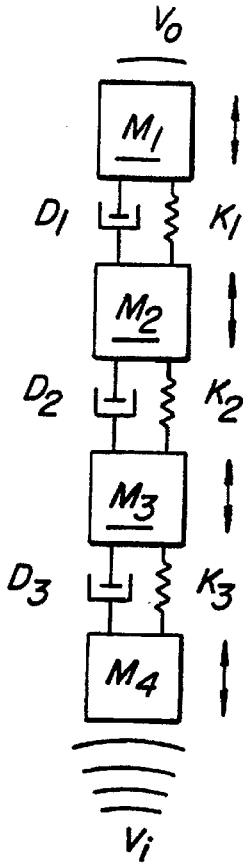
FIG. 8 is a schematic model of the isolation provided between chambers in the speaker enclosure of the present invention.

Referring now to FIG. 8, the advantages of the present speaker enclosure construction are most easily understood with reference to the multiple isolation layers described regarding FIG. 7. The individual structural layers are modeled as discrete masses separated by structural layers modeled as a combination of a spring and a damper in parallel. A vibrational input VI for example a low-frequency vibration created by the bass driver within the bass chamber, causes the lowest structural layer modeled here as M4 to vibrate. This vibration is in part absorbed by a damper layer and in part transmitted on to the adjacent structural layer represented by mass M3. The vibrations continue to propagate through the structural and damping layers gradually being attenuated by the combination of discrete masses and the elastic and damping qualities of the intervening layers. The final complete structural layer, for instance the structural layer below mid-range chamber 90 in FIG. 7, outputs only a very weak vibration, preferably one outside the audible spectrum. The effective attenuation of the system illustrated in FIG. 8 may be tailored by varying the mass's spring coefficients and damping coefficients. It will be recognized that damping layers between the structural layers forming the acoustic chambers will further reduce the transmission of vibrations through the speaker enclosure.

Figure 9:
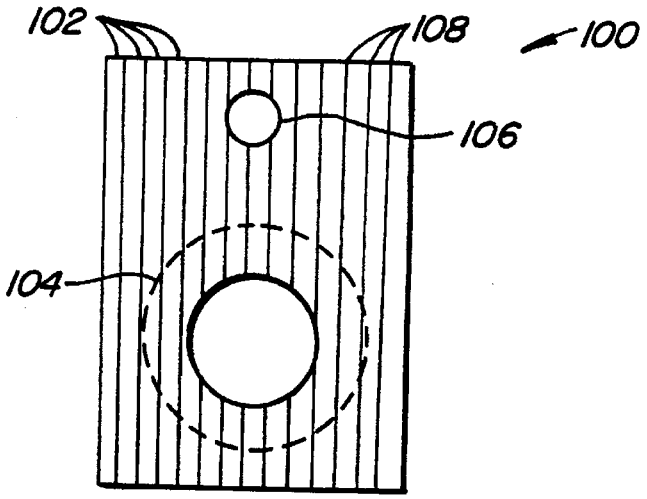
FIG. 9 is an alternative embodiment of the speaker enclosure of the present invention.

Referring now to FIG. 9, an alternative, though not necessarily preferred, speaker enclosure 100 is formed from a plurality of vertical structural layers 102 defining a first acoustic chamber 104 and a port 106. Damping layers will reduce vibrations between the side of chamber 104 and port 106. However, isolation of the drivers will be limited as vibrations will travel along the structural layers common to both the port and the chamber.

In conclusion, the present invention provides a speaker enclosure construction technique which allows flexible shaping of acoustic chambers and further provides isolation between individual shaped chambers for individual drivers. While the above is a complete description of the preferred embodiments of the invention, various alternatives may be used. For example, a speaker enclosure could make use of the described construction for a single bass driver chamber, to which a more conventional mid-range or high-frequency driver chamber is attached. Therefore, the above description should not be taken as limiting the scope of the invention which is, instead, defined by the appended claims.

What is claimed is:

1. An audio speaker enclosure comprising:

a stack of structural layers including:

a first plurality of structural layers having openings which are in communication and which define a first acoustically-shaped chamber; and a second plurality of structural layers having openings which are in communication and which define a second acoustically-shaped chamber; and a plurality of damping layers interspersed between the structural layers of the stack;

whereby the structural layers of the stack and the damping layers inhibit the transmission of vibrations between the first chamber and the second chamber.

2. An audio speaker enclosure as claimed in claim 1, wherein at least one of the first chamber and the second chamber is substantially spherical.

3. An audio speaker enclosure as claimed in claim 2, wherein the first and second chambers are substantially spherical.

4. An audio speaker enclosure as claimed in claim 1, wherein the structural layers of the stack have upper and lower major surfaces which are substantially planar.

5. An audio speaker enclosure as claimed in claim 1, wherein the structural layers comprise a material selected from the group consisting of wood, particle board, plastic, and a fiber-reinforced polymer.

6. An audio speaker enclosure as claimed in claim 1, wherein the damping layers comprise a material selected from the group containing rubber, latex, silicon, urethane, or neoprene.

7. An audio speaker enclosure as claimed in claim 1, wherein the damping layers are alternated with substantially all of the structural layers.

8. An audio speaker enclosure as claimed in claim 1, further comprising a plurality of rods holding the layers together, the rods isolated from the first and second plurality of structural layers.

9. An audio speaker enclosure as claimed in claim 1, wherein the stack of structural layers further comprises a third plurality of structural layers disposed between the first plurality of structural layers and the second plurality of structural layers and wherein at least one of the plurality of damping layers is interspersed between the structural layers of the third plurality of structural layers.

10. An audio speaker enclosure comprising:

a plurality of structural layers comprising:

a bottom layer defining a horizontal orientation and an upward orientation;

a plurality of first driver layers disposed above the bottom layer, wherein each first driver layer has an opening which is in communication with an adjacent opening of an adjacent first driver layer, the first driver layers defining a first driver port;

a plurality of isolation layers disposed above the first driver layers;

a structure defining a second driver chamber disposed above the isolation layers, the second driver structure having a second driver port in communication with the second driver chamber;

a plurality of damping layers alternated with at least the isolation layers, the damping layers comprising a damping material;

wherein the bottom layer, the openings of the first driver layers, and the isolation layers define a first chamber in communication with the first driver port; and wherein the isolation layers and the damping layers inhibit transmission of vibrations between the first chamber and the second driver chamber.

11. An audio speaker enclosure as claimed in claim 10, wherein the first chamber is substantially spherical.

12. An audio speaker enclosure as claimed in claim 10, wherein the first chamber is substantially cylindrical.

13. An audio speaker enclosure as claimed in claim 10, wherein the second driver structure comprises a plurality of second driver layers and a top layer disposed above the second driver layers, wherein each second driver layer has an opening which is in communication with an adjacent opening of an adjacent second driver layer, and wherein the isolation layers, the openings of the second driver layers, and the top layer define the second driver chamber.

14. An audio speaker enclosure as claimed in claim 13, wherein the first and second chambers are substantially spherical.

15. An audio speaker enclosure as claimed in claim 10, wherein the damping material comprises a material selected from the group containing rubber, latex, silicon, urethane, or neoprene.

16. An audio speaker enclosure as claimed in claim 10, wherein the damping layers are alternated with substantially all of the structural layers.

17. An audio speaker enclosure as claimed in claim 10, further comprising a top layer disposed above the second driver chamber and a plurality of rods securing the top layer to the bottom layer, wherein the rods are isolated from the first driver layers.

18. A method for constructing an audio speaker enclosure, the method comprising:

forming a plurality of structural layers of a rigid material, each structural layer having a lower surface, an upper surface, and a horizontal edge therebetween, a plurality of the structural layers having openings from the lower surface to the upper surface, at least one of the structural layers having an opening which extends to the horizontal edge;

forming a plurality of damping layers of a compressible elastomeric material;

stacking the structural layers with the damping layers interspersed between adjacent structural layers so that the openings are in communication, the openings together forming an acoustically-shaped chamber, the at least one extended opening forming a driver port in communication with the chamber; and securing a second driver structure over the upper surface of a structural layer with a damping layer between the upper surface and the second driver structure.

* * * * *